United States Patent [19]

Kaneko et al.

[11] Patent Number: 4,539,577

[45] Date of Patent: Sep. 3, 1985

[54] HEAT SENSITIVE RECORD MATERIAL

[75] Inventors: Kazuo Kaneko, Yokohama; Michihiro Gonda, Kitamoto; Susumu Suzuka, Yono; Katsumasa Kitsukawa, Tokyo, all of Japan

[73] Assignee: Hodogaya Chemical Co., Ltd., Tokyo, Japan

[21] Appl. No.: 651,038

[22] Filed: Sep. 14, 1984

[30] Foreign Application Priority Data

Sep. 30, 1983 [JP] Japan ..... 58-180473

[51] Int. Cl.[3] ..... B41M 5/18

[52] U.S. Cl. ..... 346/207; 346/208; 346/209; 346/221; 427/151

[58] Field of Search ..... 346/207, 208, 209, 216, 346/217, 218, 220, 221, 225; 427/150, 151, 152

[56] References Cited

U.S. PATENT DOCUMENTS 4,480,052 10/1984 Ichijima et al. ..... 346/208

*Primary Examiner*—Bruce H. Hess

*Attorney, Agent, or Firm*—Wenderoth, Lind & Ponack

[57] ABSTRACT

A heat sensitive record material comprising a support sheet and a heat sensitive record layer formed on the support sheet, the heat sensitive record layer being composed essentially of a colorless or light-colored electron-donating colorless dye, an acidic substance which is thermally reactive with the electron-donating colorless dye to develop a color and a binder, characterized in that said heat sensitive record layer contains an effective amount of at least one anilide compound represented by the general formula:

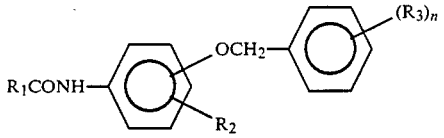

where $R_1$ is an alkyl group having 1 to 6 carbon atoms or a cycloalkyl group; $R_2$ is a hydrogen atom, an alkyl group having 1 to 4 carbon atoms, an alkoxy group having 1 to 4 carbon atoms, a sulfamoyl group or a halogen atom; $R_3$ is a hydrogen atom, an alkyl group having 1 to 4 carbon atoms, an alkoxy group having 1 to 4 carbon atoms or a halogen atom; and n is an integer of 0 to 5.

7 Claims, No Drawings

HEAT SENSITIVE RECORD MATERIAL

FIELD OF THE INVENTION

The present invention relates to a heat sensitive record material, and particularly to a heat sensitive record material having improved heat resistance, water resistance and heat sensitivity characteristics. More particularly, it relates to a heat sensitive record material having improved color-forming sensitivity and humidity decolorization resistance.

BACKGROUND OF THE INVENTION

Along with the recent development of facsimile machines, especially of high-speed facsimile machines, it has been required that the heat sensitive record material therefor be provided with eminent heat sensitive characteristics such as the color-forming sensitivity, humidity decolorization resistance and the like.

Various attempts have heretofore been made to improve the heat sensitivity characteristics of the heat sensitive record material. For example, Japanese Examined Patent Publication No. 17748/1974 and No. 39567/1976 propose to employ a combination of an organic acid as an acidic substance and a phenolic compound, or to use a polyvalent metal salt of a compound having an alcoholic hydroxyl group. Japanese Unexamined Patent Publication No. 11140/1974 (Japanese Examined Patent Publication No. 29945/1976) proposes to employ a copolymer of hydroxyethyl cellulose with a salt of maleic acid anhydride. Further, in Japanese Unexamined Patent Publications No. 34842/1974, No. 115554/1974, No. 149353/1975, No. 106746/1977, No. 5636/1978, No. 11036/1978 and No. 48751/1978, it is disclosed to incorporate, as a sensitizer, a nitrogen-containing organic compound such as thioacetanilide, phthalonitrile, acetamide, di-$\beta$-naphtyl-p-phenylenediamine, a fatty acid amide, acetoacetic anilide, diphenylamine, benzamide or carbazole, or a heat-fluidizable material such as 2,3-di-m-tolylbutane or 4,4'-dimethylbiphenyl, or a carboxylic acid ester such as dimethylisophthalate or diphenylphthalate.

The present inventors have prepared heat sensitive record papers in accordance with the conventional methods and the methods disclosed in the above-mentioned various publications by using known electron-donating colorless dyes as a chromogenic material, and tested them for various properties required for the heat sensitive record paper. As a result of the tests, it has been found that they are inferior in the heat sensitivity characteristics, i.e. the initial color-forming temperature (Ts) under heating is high, the rising temperature coefficient ($\gamma$) of the color density curve is low, or the maximum color density ($D_{max}$) is low. Thus, they are practically not useful as a heat sensitive record paper for facsimile, particularly for high-speed facsimile. Further, when the thermally color-developed record papers are left to stand in an atmosphere having a relative humidity of 80 to 90% at 50° to 60° C. for 12 to 24 hours, the density of the color-developed chromogenic material decreases as compared with the color density immediately after the color-development, and in some cases, the color disappears completely leaving no trace of the color-developed chromogenic material. Thus, the humidity decolorization resistance is poor, so that the commercial value of such heat sensitive record paper will be impaired.

SUMMARY OF THE INVENTION

An object of the present invention is therefore to provide an improved heat sensitive record material using known electron-donating colorless dyes and having eminent color-forming sensitivity and humidity decolorization resistance.

According to the present invention, there is provided a heat sensitive record material comprising a support sheet and a heat sensitive record layer formed on the support sheet. The heat sensitive record layer is composed essentially of a colorless or light-colored electron-donating colorless dye, an acidic substance which is thermally reactive with the electron-donating colorless dye to develop a color and a binder. The present invention is characterized by the heat sensitive record layer containing therein an effective amount of at least one anilide compound represented by the general formula:

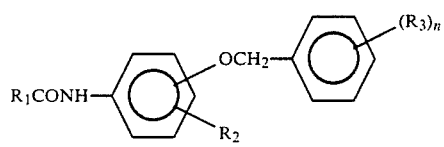

(I)

where $R_1$ is an alkyl group having 1 to 6 carbon atoms or a cycloalkyl group; $R_2$ is a hydrogen atom, an alkyl group having 1 to 4 carbon atoms, an alkoxy group having 1 to 4 carbon atoms, a sulfamoyl group or a halogen atom; $R_3$ is a hydrogen atom, an alkyl group having 1 to 4 carbon atoms, an alkoxy group having 1 to 4 carbon atoms or a halogen atom; and n is an integer of 0 to 5.

DESCRIPTION OF PREFERRED EMBODIMENTS

The anilide compounds or derivatives of anilide represented by the general formula (I) are usually synthesized by the reaction of aminophenols with benzyl chlorides. Typical anilide compounds include 2-benzyloxyacetanilide, 2-(2-chlorobenzyloxy)-acetanilide, 2-(3-chlorobenzyloxy)-acetanilide, 2-(4-chlorobenzyloxy)-acetanilide, 2-(4-methylbenzyloxy)-acetanilide, 2-(3-fluorobenzyloxy)-acetanilide, 2-(4-bromobenzyloxy)-acetanilide, 3-benzyloxyacetanilide, 3-(2-chlorobenzyloxy)-acetanilide, 3-(3-chlorobenzyloxy)-acetanilide, 3-(2-fluorobenzyloxy)-acetanilide, 3-(4-ethylbenzyloxy)-acetanilide, 3-(3-bromobenzyloxy)-acetanilide, 4-benzyloxyacetanilide, 4-(2-chlorobenzyloxy)-acetanilide, 4-(3-chlorobenzyloxy)-acetanilide, 4-(4-chlorobenzyloxy)-acetanilide, 4-(4-methylbenzyloxy)-acetanilide, 4-(4-bromobenzyloxy)-acetanilide, 5-sulfamoyl-2-(4-methoxybenzyloxy)-propionanilide, 5-methyl-2-benzyloxy-propionanilide, 5-chloro-2-(3,4-dichlorobenzyloxy)-acetanilide, 2-methyl-4-(4-methylbenzyloxy)-butylanilide, 4-methoxy-2-(2,3,4-trichlorobenzyloxy)-acetanilide, 5-bromo-2-(3-methylbenzyloxy)-cyclohexylcarboxyanilide and 4-ethyl-2-(2-bromobenzyloxy)-n-caproanilide. However, the anilide compounds that can be used in the present invention are not restricted to the above-exemplified compounds.

The colorless or light-colored electron-donating colorless dye i.e. the chromogenic material to be used for the heat sensitive record material of the present invention may be selected from the conventionally known electron-donating colorless dyes. Typical examples of such colorless dyes are 2-(2-chlorophenylamino)-6-diethylaminofluoran, 2-(2-chlorophenylamino)-6-di-n-butylaminofluoran, 2-anilino-3-methyl-6-diethylaminofluoran, 2-anilino-3-methyl-6-pyrrolidinylfluoran, 2-anilino-3-methyl-6-piperidinofluoran, 2-(3-trifluoromethylanilino)-6-diethylaminofluoran, 2-anilino-6-diethylaminofluoran, 2-anilino-3-methyl-6-(N-ethyl-N-p-tolyl)aminofluoran, 2-(p-ethoxyanilino)-3-methyl-6-diethylaminofluoran, 2-(3,5-xylidino)-3-methyl-6-diethylaminofluoran, 2-anilino-3-methyl-6-(N-methyl-N-cyclohexylamino)fluoran, 2-anilino-3-chloro-6-diethylaminofluoran, 2-anilino-3,4-dimethyl-6-diethylaminofluoran, 2-anilino-3-methoxy-6-dibutylaminofluoran, 2-anilino-3-methyl-6-(N-ethyl-N-isoamyl-)aminofluoran, 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)-phthalide, 4,4'-bis-dimethylaminobenzhydrindyl ether, 3-methyl-spiro-dinaphthopyran and 3-ethyl-spiro-dinaphthopyran. However, the electron-donating colorless dyes that can be employed in the present invention are not restricted to the above-exemplified compounds.

The acidic substance i.e. the developer to be used in the present invention is solid at room temperature and capable of being reacted with the chromogenic material when heated. Typical acidic substances include phenolic compounds disclosed in British Pat. No. 1,135,540, colorless solid organic acids such as stearic acid, benzoic acid, gallic acid, and salicylic acid which are liquefied or vaporized at a temperature of 50° C. or higher and their metal salts such as aluminum or zinc salts. Particularly preferred acidic substances are the phenolic compounds, and a typical example thereof is 4,4'-isopropylidene-diphenol (bisphenol A).

The anilide compounds represented by the general formula (I) are easily prepared by using a general synthetic method in which hydroxyacetanilides (1 molar ratio) and sodium hydroxide (1.14 molar ratio) as a deacidifying agent are added in methanol and substituted benzyl chlorides (1.14 molar ratio) is then added to the mixture to react the chlorides with the hydroxyacetanilides. The following Synthesis Examples illustrate typical synthetic method for preparation of the anilide compounds. "Parts" given in the examples are by weight.

SYNTHESIS EXAMPLE 1

Preparation of 3-benzyloxyacetanilide (Compound No. A in Table I)

2-Hydroxyacetanilide (15.1 parts) is added to methanol (30 parts). Into this mixture is further added a solution of sodium hydroxide (4.8 parts) in water (14 parts). The resulting mixture is kept at 60° C. and add dropwise benzyl chloride (14.4 parts) within 30 minutes, and the reaction is continued for 5 hours at 60° to 65° C. After completion of the reaction, the reaction mixture is poured into cold water (250 parts) and is then filtered. The filter cake obtained is washed with water and the resulting white cake is dried at 60° to 70° C. to yield the intended product (20.5 parts) having melting point 111.0° to 113.0° C.

SYNTHESIS EXAMPLE 2

Preparation of 2-(2-chlorobenzyloxy)acetanilide (Compound No. B in Table I)

2-Hydroxyacetanilide (15.1 parts) is added to methanol (60 parts). Into this mixture is further added a solution of sodium hydroxide (4.8 parts) in water (14 parts). The resulting mixture is kept at 0° to 5° C. and add dropwise 2-chlorobenzyl chloride (18.3 parts) within 30 minutes, and the reaction is continued for 2 hours at 0° to 5° C., for additional 6 hours at 30° to 40° C. and further for additional 2 hours at 65° C. After completion of the reaction, the reaction mixture is poured into cold water (250 parts) and is then filtered. The filter cake obtained is washed with water and the resulting white cake is dried at 80° C. to yield the intended product (22.3 parts) having melting point 130° to 132° C.

Typical anilide compounds which were synthesized in the same manner as described in the Synthesis Examples 1 and 2 are given in Table I.

TABLE I

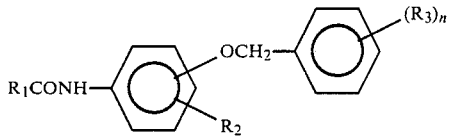

| Compound No. | Structure of Compound | Melting point (°C.) |
|---|---|---|
| A | 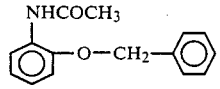 | 111.0–113.0 |
| B | 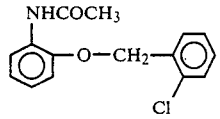 | 130.0–132.0 |
| C | 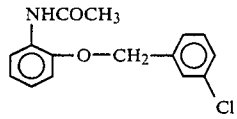 | 112.0–114.0 |
| D | 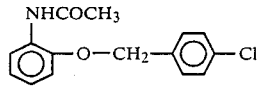 | 149.0–151.0 |
| E | 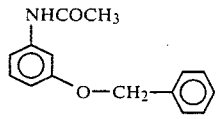 | 120.0–122.0 |
| F | 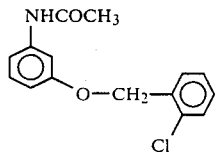 | 95.0–97.5 |
| G | 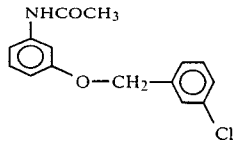 | 110.0–112.0 |
| H | 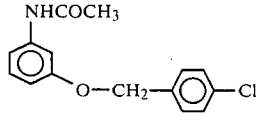 | 111.0–113.0 |

TABLE I-continued

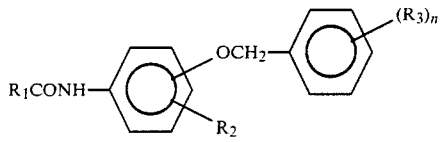

| Compound No. | Structure of Compound | Melting point (°C.) |
|---|---|---|
| I | 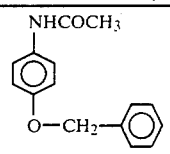 | 137.0–139.0 |
| J | 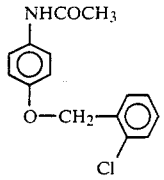 | 126.0–128.0 |
| K | 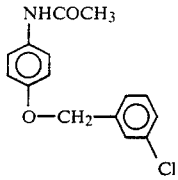 | 148.0–150.5 |
| L | 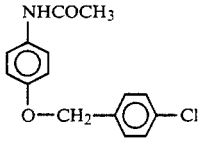 | 180.0–182.0 |
| M | 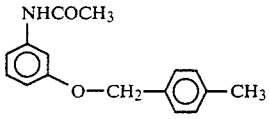 | 119.0–121.5 |
| N | 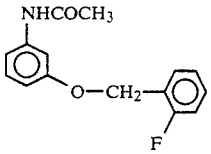 | 109.5–113.5 |

As the binder to bond a mixture comprising the chromogenic material, the acidic substance and the anilide compound to the support sheet, there may be used a water soluble or water insoluble binder. Typical examples are polyvinyl alcohol, methyl cellulose, hydroxyethyl cellulose, carboxymethyl cellulose, gum arabic, starch, gelatin, casein, polyvinyl pyrrolidone, a styrene-maleic anhydride copolymer, a polyacrylamide, a polyacrylic acid salt, a terpene resin and a petroleum resin. Particularly preferred for the purpose of the present invention is a water soluble binder, typically polyvinyl alcohol.

In the preparation of the heat sensitive record material of the present invention, it is preferred from the viewpoint of the properties of the heat sensitive record material to provide a single heat sensitive record layer in which the electron-donating colorless dye as a chromogenic material, the acidic substance and at least one anilide compound of the general formula (I) are uniformly distributed in the form of fine particles. If necessary, an effective amount of sensitizer such as, for example, benzenesulfonamide compounds disclosed in a copending Japanese Patent Application No. 54047/1983 filed Mar. 31, 1983 of the common assigne herewith, may be incorporated in the single heat sensitive record layer. The heat sensitive record material of the present invention may be prepared by employing a method wherein the chromogenic material and the anilide compound are uniformly distributed in fine particle form in a first layer which is juxtaposed with a second layer in which fine particles of the acidic substance are uniformly distributed; or a method wherein the acidic substance and the anilide compound are uniformly distributed in fine particle form in a first layer which is juxtaposed with a second layer in which fine particles of the chromogenic material are uniformly distributed; or a method wherein the chromogenic material, the anilide compound and the acidic substance are uniformly distributed in the respective separate layers which are intimately adhered to one another.

The composition of the heat sensitive record layer usually contains the anilide compound of the general formula (I) in an anount of 0.1 to 10, preferably 0.3 to 3 parts by weight, the acidic substance in an amount of 1 to 10, preferably 2 to 6 parts by weight and the binder in an amount of 0.3 to 3, preferably 0.5 to 1 parts by weight, per 1 part by weight of the chromogenic material.

The chromogenic material, the acidic substance and the anilide compound are preferably separately dispersed and pulverized in aqueous or organic media containing the binder, preferably in aqueous media in which the binder is dissolved, by means of a dispersing machine such as a ball mill, a sand mill or a paint conditioner, to obtain dispersions containing the respective particles having a particle size of 1 to 6 μm, preferably 3 to 5 μm. If necessary, an antifoaming agent, a dispersing agent or a brightening agent may be added at the time of the dispersing and pulverization.

The respective dispersions thus obtained are mixed to obtain a coating composition comprising the respective components in the above-mentioned weight ratio for the heat sensitive record layer. This coating composition is applied onto the surface of a support sheet, such as paper, by means of a wire bar coater #6 to #10 so that the weight of the solid after drying becomes to be 3 to 7 g/m$^2$, and then dried in an air-circulating drier at a temperature of from room temperature to 70° C., to obtain a heat sensitive record paper. If necessary, an inorganic or organic filler may be added to the coating composition to improve the anti-adhension to the heating head or the writability.

The heat sensitive record material of the present invention thus obtained has superior heat sensitivity, heat decolorization resistance, humidity decolorization resistance and water resistance, and is free from the whitening phenomenon which impairs the commercial value of the heat sensitive record material, and hence the drawbacks inherent to the conventional heat sensitive record materials have been overcome.

The properties of the record layer of the heat sensitive record material were determined by the following test methods. Namely, the color densities such as the color density of the self-color development, the color density after the heat color development at various temperatures and the decolorization density of the chromogenic materials left in the heated or humidified atmosphere after the heat color development, were measured by means of Macbeth RD-514 Model reflective density meter. The color development was conducted at a heating temperature of 70° to 160° C. for a heating time of 5 seconds under a load of 100 g/cm$^2$ by means of Rhodiaceta type thermotester (manufactured by French National Fiber Research Institute). Further, the declorization of the chromogenic materials after the heat color development was conducted in a constant temperature and humidity testing apparatus.

The following Examples are intended to illustrate the invention and are not to be construed as being limitations thereon. "Parts" given in the Examples are by weight.

EXAMPLE 1

| | |
|---|---|
| Dispersion A (Dispersion of a chromogenic material) | |
| 2-(2-Chlorophenylamino)-6-dibuthylamino-fluoran | 4.0 parts |
| Aqueous solution containing 10% by weight of polyvinyl alcohol | 40.0 parts |
| Dispersion B (Dispersion of a developer) | |
| 4,4'-Isopropylidenediphenol (bisphenol A) | 7.0 parts |
| Aqueous solution containing 10% by weight polyvinyl alcohol | 40.0 parts |
| Water | 10.0 parts |
| Dispersion C (Dispersion of an anilide compound) | |
| Anilide compound (Compound Nos. A to N in Table I) | 7.0 parts |
| Aqueous solution containing 10% by weight of polyvinyl alcohol | 40.0 parts |
| Water | 10.0 parts |

Each dispersion having the above composition was pulverized in a ball mill to a particle size of 2 to 3 μm.

Then, the dispersions were mixed in the following proportions to obtain a coating composition.

| | |
|---|---|
| Dispersion A (Dispersion of the chromogenic compound) | 3.0 parts |
| Dispersion B (Dispersion of the developer) | 10.0 parts |
| Dispersion C (Dispersion of the anilide compound) | 3.0 parts |

As a Comparative Example, Dispersions A and B were mixed in the following proportions to obtain another coating composition.

| | |
|---|---|
| Dispersion A (Dispersion of the chromogenic material) | 3.0 parts |
| Dispersion B (Dispersion of the developer) | 10.0 parts |
| Water | 3.0 parts |

Each of these coating compositions was coated on the surface of a sheet of high quality paper by means of a wire bar coater #10 in such an amount that the weight of the solid after drying became 5 g/m$^2$, and then dried in an air-circulating drier. The heat sensitive record paper thus obtained was subjected to various property tests for the heat sensitive record paper. The results are shown in Table II, in which the heat sensitive record papers of the present invention are identified by (a) to (n), and the heat sensitive record paper of the Comparative Example is identified by (o).

TABLE II

| Heat sensitive record paper No. | Anilide Compound No. | Color-forming characteristics | | | | |
|---|---|---|---|---|---|---|
| | | Ts(°C.)*1 | γ*1 | D*2 | $D_{1.0}$(°C.)*3 | Humidity*4 resistance (%) |
| Example of the invention | | | | | | |
| a | A | 69.0 | 6.1 | 1.27 | 96.8 | 88.0 |
| b | B | 74.0 | 6.2 | 1.25 | 96.0 | 94.1 |
| c | C | 63.0 | 6.3 | 1.26 | 95.0 | 88.4 |
| d | D | 89.5 | 8.7 | 1.25 | 94.0 | 92.3 |
| e | E | 75.5 | 6.7 | 1.29 | 93.0 | 97.8 |
| f | F | 61.5 | 6.1 | 1.31 | 92.2 | 95.2 |
| g | G | 72.5 | 8.2 | 1.33 | 90.0 | 99.1 |
| h | H | 68.0 | 8.0 | 1.28 | 95.0 | 101.6 |
| i | I | 82.5 | 8.7 | 1.28 | 98.0 | 96.8 |
| j | J | 80.0 | 7.0 | 1.28 | 91.0 | 95.1 |
| k | K | 90.1 | 11.8 | 1.26 | 95.0 | 94.2 |
| l | L | 99.0 | 10.0 | 1.23 | 102.0 | 98.3 |
| m | M | 74.2 | 8.1 | 1.29 | 92.0 | 97.0 |
| n | N | 72.3 | 7.5 | 1.28 | 91.8 | 94.8 |
| Comparative Example | | | | | | |
| o | — | 124.0 | 5.6 | 1.22 | 137.0 | 61.5 |

Notes:

*1"γ" represents a value obtained by multiplying tan θ by 100 where tan θ is the maximum inclination in the color density-color forming temperature curve in a graph in which the color density is represented by the abscissa and the color development temperature is represented by the ordinate. The value "γ" represents the rising coefficient of the color development. Further, "Ts" is an intersection of the tangent at the maximum inclination with the temperature axis (ordinate), and it represents the initial temperature of the color development. The heat color development was conducted at a heating temperature of 70 to 160° C. for a heating time of 5 seconds under a load of 100 g/cm$^2$ by means of Rhodiaceta type thermotester (manufactured by French National Fiber Research Institute).

*2"D" represents the color density immediately after color development. The color density was measured by a visual filter by means of Macbeth reflective density meter RD-514 Model. The heat color development was conducted at a temperature of 150° C. for 3 seconds under a load of 100 g/cm$^2$.

*3"$D_{1.0}$" represents the temperature at which the practical color density reaches the value of 1.0. The color density was measured by a visual filter by means of Macbeth reflective density meter RD-514 Model.

*4The humidity resistance is calculated by the following equation:

$$\frac{\text{color density (D') after being kept under heated and humidified condition}}{\text{color density (D) immediately after color development}} \times 100.$$

The color density (D') was measured after the color-developed record paper was kept at 60° C. for 24 hours under a relative humidity (RH) of 80%.

It is evident from Table II that the heat sensitive record papers (a) to (n) of the present invention have higher color density than the heat sensitive record paper (o) of the Comparative Example, and they are particularly superior in the color-forming sensitivity (Ts, γ) and humidity resistance of the thermally developed color.

EXAMPLE 2

Dispersion B (dispersion of the developer) and Dispersion C (dispersion of the anilide compound; Compound Nos. G and E in Table I) were prepared in the same manner as in Example 1.

| | |
|---|---|
| Dispersion D (Dispersion of a chromogenic material) | |
| 2-Anilino-3-methyl-6-(N—ethyl-N—p-tolyl)-aminofluoran | 4.0 parts |

-continued

| Dispersion D (Dispersion of a chromogenic material) | |
|---|---|
| Aqueous solution containing 10% by weight of polyvinyl alcohol | 40.0 parts |

The dispersion D having the above composition was pulverized in a ball mill to a particle size of 2 to 3 μm.

Then the dispersions were mixed in the following proportions to obtain a coating composition.

| | |
|---|---|
| Dispersion D (Dispersion of the chromogenic material) | 3.0 parts |
| Dispersion B (Dispersion of the developer) | 10.0 parts |
| Dispersion C (Dispersion of the anilide compound: (Compound Nos. G and E in Table I) | 3.0 parts |

Further, as a Comparative Example, Dispersions D and B were mixed in the following proportions to obtain another coating composition.

| | |
|---|---|
| Dispersion D (Dispersion of the chromogenic material) | 3.0 parts |
| Dispersion B (Dispersion of the developer) | 10.0 parts |
| Water | 3.0 parts |

Each of these coating compositions was applied onto the surface of high quality paper in the same manner as in Example 1 to obtain the heat sensitive record paper which was then subjected to various property tests for the heat sensitive record paper. The results are shown in Table III, wherein the heat sensitive record papers of the present invention are identified by (p) and (q) and the heat sensitive record paper of the Comparative Example is identified by (r).

TABLE III

| | Heat sensitive record Paper No. | Anilide Compound No. | Color-forming characteristics *1 Ts (°C.) | *1 γ | *2 D | *3 $D_{1.0}$ (°C.) | *4 Humidity resistance (%) |
|---|---|---|---|---|---|---|---|
| Example 2 of the invention | p | G | 75.6 | 8.6 | 1.25 | 92.5 | 98.4 |
| | q | E | 78.0 | 6.7 | 1.24 | 94.0 | 95.7 |
| Comparative Example | r | — | 128.0 | 5.7 | 1.12 | 141.5 | 59.8 |

It is apparent from Table III that the heat sensitive record papers (p) and (q) of the present invention have higher color density than the heat sensitive record paper (r) of the Comparative Example, and they are particularly superior in the color-forming sensitivity (Ts, γ) and the humidity resistance of the thermally developed color.

EXAMPLE 3

Dispersion A (dispersion of the chromogenic material) and Dispersion B (dispersion of the developer) were prepared in the same manner as in Example 1.

| Dispersion E (Dispersion of an anilide compound) | |
|---|---|
| Anilide compound (Compound No. G in Table I) | 7.0 parts |
| Aqueous solution containing 10% by weight of polyvinyl alcohol | 40.0 parts |
| Water | 10.0 parts |
| Dispersion F (Dispersion of an anilide compound) | |
| Anilide compound (Compound No. I in table I) | 7.0 parts |
| Aqueous solution containing 10% by weight of polyvinyl alcohol | 40.0 parts |
| Water | 10.0 parts |
| Dispersion G (Dispersion of benzenesulfoanilide) | |
| Benzenesulfoanilide | 7.0 parts |
| Aqueous solution containing 10% by weight of polyvinyl alcohol | 40.0 parts |
| Water | 10.0 parts |

Each dispersion having the above composition was pulverized in a ball mill to a particle size of 2 to 3 μm.

Then these dispersions were mixed in the following proportions to obtain a coating composition.

| | |
|---|---|
| Dispersion A (Dispersion of the chromogenic material) | 3.0 parts |
| Dispersion B (Dispersion of the developer) | 10.0 parts |
| Dispersion E (Dispersion of the anilide compound; Compound No. G in Table I) | 1.5 parts |
| Dispersion F (Dispersion of the anilide compound; Compound No. I in Table I) | 1.5 parts |
| Dispersion A (Dispersion of the chromogenic material) | 3.0 parts |
| Dispersion B (Dispersion of the developer) | 10.0 parts |
| Dispersion F (Dispersion of the anilide compound; Compound No. I in Table I) | 1.5 parts |
| Dispersion G (Dispersion of benzenesulfoanilide) | 1.5 parts |

Each of these coating compositions was applied onto the surface of high quality paper in the same manner as in Example 1 to obtain the heat sensetive record paper which was then subjected to various property tests for the heat sensitive record paper. The results are shown in Table IV, wherein the heat sensitive record papers of the present invention are identified by (s) and (t) and the heat sensitive record paper of the Comparative Example in Example 1 is identified by (o).

TABLE IV

| | Heat sensitive record Paper No. | Anilide Compound No. | Color-forming characteristics *1 Ts(°C.) | *1 γ | *2 D | *3 $D_{1.0}$ (°C.) | *4 Humidity resistance (%) |
|---|---|---|---|---|---|---|---|
| Example 3 of the invention | s | G + I | 71.2 | 6.5 | 1.27 | 91.2 | 98.1 |
| | t | I + Benzenesulfoanilide | 70.0 | 6.1 | 1.29 | 92.1 | 96.3 |
| Comparative Example | 0 | — | 124.0 | 5.6 | 1.22 | 137.0 | 61.5 |

It is apparent from Table IV that the heat sensitive record papers (s) and (t) of the present invention have higher color density than the heat sensitive record paper (o) of the comparative Example, and they are particularly superior in the color-forming sensitivity (Ts, γ) and the humidity resistance of the thermally developed color.

EXAMPLE 4

Dispersion B (dispersion of the developer) and Dispersion C (dispersion of the anilide compound; Compound No. E in Table I) were prepared in the same manner as in Example 1.

| Dispersion H (dispersion of a chromogenic material) | |
|---|---|
| 2-Anilino-3-methyl-6-N—methyl-N—cyclohexylamino-fluoran | 4.0 parts |
| Aqueous solution containing 10% by weight of polyvinyl alcohol | 40.0 parts |

The dispersion having the above composition was pulverized in a ball mill to a particle size of 2 to 3 μm.

Then the dispersions were mixed in the following proportions to obtain a coating composition.

| | |
|---|---|
| Dispersion H (Dispersion of the chromogenic material) | 3.0 parts |
| Dispersion B (Dispersion of the developer) | 10.0 parts |
| Dispersion C (Dispersion of the anilide compound; Compound No. E in Table I) | 3.0 parts |

Further, as a Comparative Example, Dispersions H and B were mixed in the following proportions to obtain another coating composition.

| | |
|---|---|
| Dispersion H (Dispersion of the chromogenic material) | 3.0 parts |
| Dispersion B (Dispersion of the developer) | 10.0 parts |
| Water | 3.0 parts |

Each of these coating compositions was applied onto the surface of high quality paper in the same manner as in Example 1 to obtain the heat sensitive record paper which was then subjected to various property tests for the heat sensitive record paper. The results are shown in Table V, wherein the heat sensitive record apper of the present invention is identified by (u) and the heat sensitive record paper of the Comparative Example is identified by (v).

TABLE V

| | Heat sensitive record Paper No. | Anilide Compound No. | Color-forming characteristics *1 Ts(°C.) | *1 γ | *2 D | *3 $D_{1.0}$ (°C.) | *4 Humidity resistance (%) |
|---|---|---|---|---|---|---|---|
| Example 4 of the invention | u | E | 74 | 10.0 | 1.30 | 85 | 104 |
| Comparative Example | v | — | 98 | 3.8 | 1.25 | 127 | 62 |

Notes:
*1 to *4 in Tables III, IV and V have the same meanings as described with respect to Table II.

It is apparent from Table V that the heat sensitive record paper (u) of the present invention has higher color density than the heat sensitive record paper (v) of the Comparative Example, and it is particularly superior in the color-forming sensitivity (Ts, γ) and the humidity resistance of the thermally developed color.

What is claimed is:

1. A heat sensitive record material comprising a support sheet and a heat sensitive record layer formed on the support sheet, the heat sensitive record layer being composed essentially of a colorless or light-colored electron-donating colorless dye, an acidic substance which is thermally reactive with the electron-donating colorless dye to develop a color and a binder, characterized in that said heat sensitive record layer contains an effective amount of at least one anilide compound represented by the general formula:

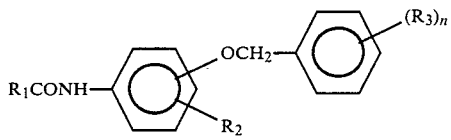

(I)

where $R_1$ is an alkyl group having 1 to 6 carbon atoms or a cycloalkyl group; $R_2$ is a hydrogen atom, an alkyl group having 1 to 4 carbon atoms, an alkoxy group having 1 to 4 carbon atoms, a sulfamoyl group or a halogen atom; $R_3$ is a hydrogen atom, an alkyl group having 1 to 4 carbon atoms, an alkoxy group having 1 to 4 carbon atoms or a halogen atom; and n is an integer of 0 to 5.

2. The heat sensitive record material according to claim 1, wherein the heat sensitive record layer contains at least one anilide compound of the general formula (I) in an amount of 0.1 to 10 parts by weight relative to 1 part by weight of the electron-donating colorless dye.

3. The heat sensitive record material according to claim 1, wherein the heat sensitive record layer comprises 1 part by weight of the electron-donating colorless dye, 0.1 to 10 parts by weight of at least one anilide compound of the general formula (I), 1 to 10 parts by weight of the acidic substance, 0.3 to 3 parts by weight of the binder.

4. The heat sensitive record material according to claim 1, wherein the anilide compound of the general formula (I) is selected from the group consisting of 2-benzyloxyacetanilide, 2-(2-chlorobenzyloxy)-acetanilide, 2-(3-chlorobenzyloxy)-acetanilide, 2-(4-chlorobenzyloxy)-acetanilide, 2-(4-methylbenzyloxy)-acetanilide, 2-(3-fluorobenzyloxy)-acetanilide, 2-(4-bromobenzyloxy)-acetanilide, 3-benzyloxyacetanilide, 3-(2-chlorobenzyloxy)-acetanilide, 3-(3-chlorobenzyloxy)-acetanilide, 3-(2-fluorobenzyloxy)-acetanilide, 3-(4-ethylbenzyloxy)-acetanilide, 3-(3-bromobenzyloxy)-acetanilide, 4-benzyloxyacetanilide, 4-(2-chlorobenzyloxy)-acetanilide, 4-(3-chlorobenzyloxy)-acetanilide, 4-(4-chlorobenzyloxy)-acetanilide, 4-(4-methylbenzyloxy)-acetanilide, 4-(4-bromobenzyloxy)-acetanilide, 5-sulfamoyl-2-(4-methoxybenzyloxy)-propionanilide, 5-methyl-2-benzyloxypropionanilide, 5-chloro-2-(3,4-dichlorobenzyloxy)-acetanilide, 2-methyl-4-(4-methylbenzyloxy)-butylanilide, 4-methoxy-2-(2,3,4-trichlorobenzyloxy)-acetanilide, 5-bromo-2-(3-methylbenzyloxy)-cyclohexylcarboxyanilide and 4-ethyl-2-(2-bromobenzyloxy)-n-caproanilide.

5. The heat sensitive record material according to claim 1, wherein the electron-donating colorless dye is selected from the group consisting of 2-(2-chlorophenylamino)-6-diethylaminofluoran, 2-(2-chlorophenylamino)-6-di-n-butylaminofluoran, 2-anilino-3-methyl-6-diethylaminofluoran, 2-anilino-3-methyl-6-pyrrolidinylfluoran, 2-anilino-3-methyl-6-piperidinofluoran, 2-(3-trifluoromethylanilino)-6-diethylaminofluoran, 2-anilino-6-diethylaminofluoran, 2-anilino-3-methyl-6-(N-ethyl-N-p-tolyl)aminofluoran, 2-(p-ethoxyanilino)-3-methyl-6-diethylaminofluoran, 2-(3,5-xylidino)-3-methyl-6-diethylaminofluoran, 2-anilino-3-methyl-6-(N-methyl-N-cyclohexylamino)fluoran, 2-anilino-3-chloro-6-diethylaminofluoran, 2-anilino-3,4-dimethyl-6-diethylaminofluoran, 2-anilino-3-methoxy-6-dibutylaminofluoran, 2-anilino-3-methyl-6-(N-ethyl-N-isoamyl)aminofluoran, 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)-phthalide, 4,4'-bis-dimethylamino-benzhydrindyl ether, 3-methyl-spiro-dinaphthopyran and 3-ethyl-spiro-dinaphthopyran.

6. The heat sensitive record material according to claim 1, wherein the acidic substance is a solid phenolic compound, a colorless solid organic acid which is liquefied or vaporized at a temperature of 50° C. of higher, or a metal salt of said organic acid.

7. The heat sensitive record material according to claim 1, wherein the electron-donating colorless dye, the acidic substance and the anilide compound of the general formula (I) are uniformly distributed in the heat sensitive record layer in particle form having a particle size of 1 to 6 $\mu$m.

* * * * *